US005145258A

United States Patent [19]

Schneck et al.

[11] Patent Number: 5,145,258

[45] Date of Patent: Sep. 8, 1992

[54] HINGED HANDLE FOR MULTIPLE PLY BAG

[75] Inventors: Gene D. Schneck, Vancouver; John W. Wagner, Battle Ground, both of Wash.

[73] Assignee: Bemis Company Inc., Vancouver, Wash.

[21] Appl. No.: 804,087

[22] Filed: Dec. 6, 1991

[51] Int. Cl.[5] ..... B65D 33/06

[52] U.S. Cl. ..... 383/14; 383/10; 383/25; 383/30; 383/79

[58] Field of Search ..... 383/14, 6, 10, 15, 79, 383/25, 30

[56] References Cited

U.S. PATENT DOCUMENTS

| | | | |
|---|---|---|---|
| 2,041,375 | 5/1936 | Schmerler | 383/30 |
| 2,050,967 | 8/1936 | Farmer | 383/14 |
| 2,093,977 | 9/1937 | Farmer | 383/14 |
| 2,625,318 | 1/1953 | Ross | 383/14 |
| 2,661,892 | 12/1953 | King | 383/30 |
| 2,957,618 | 10/1960 | Bowen | 383/14 |
| 3,116,009 | 12/1963 | Williams et al. | 383/79 |
| 3,463,381 | 8/1969 | Wainberg | 383/15 |
| 4,148,431 | 4/1979 | Lepisto | 383/14 |
| 4,902,140 | 2/1990 | Branson | 383/25 |

FOREIGN PATENT DOCUMENTS

| | | | |
|---|---|---|---|
| 542114 | 6/1957 | Canada | 383/14 |
| 590802 | 1/1960 | Canada | 383/14 |
| 8772079 | 6/1971 | Canada | 383/14 |
| 1237292 | 6/1960 | France | 383/30 |
| 2480243 | 10/1981 | France | 383/14 |

*Primary Examiner*—Stephen P. Garbe

*Attorney, Agent, or Firm*—Lee, Mann, Smith, McWilliams, Sweeney & Ohlson

[57] ABSTRACT

A flexible hinged handle sewn to the closure strip of a multiple ply bag. The hinged handle has a generally U-shaped and a pair of notches pivotably joining a grip member to the legs of the U-shape so that the grip is pivotal to provide a comfortable grasping surface for lifting the bag when filled with a product.

22 Claims, 2 Drawing Sheets

HINGED HANDLE FOR MULTIPLE PLY BAG

BACKGROUND OF THE INVENTION

The invention is generally directed to a handle for a package. More particularly, the invention involves a unique pivoting handle attachable at the upper closure strip of a multiple ply bag of the type used for packaging bulk comodities, such as powdered milk, granular compounds, fertilizer, seed and the like.

It has been a desire in the packaging industry to construct a thin flexible handle for multiple ply bags. Prior art handles, usually made of paper or molded plastic, have inherent deficiencies in that either they cannot be substantially flattened against the bag for wrinkle-free storage and subsequent filling procedures, or do not provide a comfortable carrying grip for the purchaser of the packaged goods.

Some previous attempts at providing a foldable bag handle have involved the use of a folded tape or strapping, as exemplified by U.S. Pat. No. 2,625,318 to Ross. This patent shows the use a strip of relatively strong flexible paper in order that a 90° fold may be obtained. However, a flexible strip or handle for a multiple ply bag, such as well known side-gusseted multiple ply bags with pinched end closures, would cause serious difficulties in the bag handling process. Many automated bag handling machines require that, if a handle is provided, it remain in close proximity to the package exterior. If the handles flex to bend away from the package exterior jamming of the filling and handling equipment occurs.

Prior art handle designs have often required a folded tape or flexible paper handle to be glued and/or sewn to a paper bag. This type of affixing provides an inadequate jointed connection for most multi-wall paper bags. The inadequacy stems from the weak connection, since only the outer wall of the paper bag is glued-bonded to the handle. Because three or more plies of paper are often employed in modern day multi-wall bags, there would be no anchoring possible to the other inward plies. This is further compounded in that typically the outer bag, to which such a handle might be glued, is relatively weak and is designed for the application of appealing graphics for point-of-sale attraction of consumers.

Previous attempts at sewing flexible handles to multiply bags have resulted in weakened attachments. Conventionally multi-walled bag closures and strips are sewn with three to four stiches per linear inch. This known pattern density has developed through years of practice in the industry. More dense patterns, greater than four, tend to perforate the paper to the degree that it causes closure end weakness. As a result, the bag tends to "zipper" open, similar to the perforate lines of separation between paper towel segments on a roll. On the other hand, less dense patterns, less than three, tend to create leakage of the package commodity, which is often a powdered material, such as dry milk, because wide gaps are left between stiches. As a result, the type of flexible handles as typified in the U.S. Pat. No. 2,625,318 would provide a handle that, although narrow enough to fit a normal person's hand, would not provide sufficient width at the sewn connection to be held by an adequate number of stitches.

Through experimentation, the inventors have found that the width of the material used in the handle base for attachment to the closure strips of a multi-wall bag, particularly of the type for commodities weighing from about twenty to thirty pounds, needs to be about 1½ inches in width to be anchored properly to the bag. If narrower handles bases are used, there is not sufficient distribution of the load over wide enough area of the package. Narrower bases lead to a damaging condition in that the handle will loosen the threaded closure. As a result, the package is susceptible of tearing away from the handle bond areas. Accordingly, a major object of the present invention is to provide a handle that distributes the loading force over a sufficiently wide area so that damage to the bag closure and handle attachment do not occur.

The inherent difficulties in using folded, or thick single ply paper strips, as handles is the extreme difficulty in the handling techniques for known bag making machinery. Therefore, the industry has moved toward the use of plastic handles, which allow for greater strength. Heretofore, the use of plastic handles created other problems by not providing sufficiently thin contours that allow multi-walled bags to be fed through bag handling and filling machinery.

The thickness of plastic handles is usually directly proportional to the weight to be carried. For example, in a standard bag of about twenty to twenty-five pounds content, even a dense paper handle would require a material thickness of greater than 0.040 inches in order to be adequate to hold the bag weight without tearing. Of course, the thickness of a paper handle doubles when folded over, as has been typical in prior art paper handle constructions. When a folded paper handle has been required to lie flat against a bag surface, it accentuates the thickness of the handle above the exterior bag surface. Folding can cause a 0.040 inch paper stock to become 0.100 inches or more when folded into the shape of a handle grip. In fact, the resultant handle creates a thickness greater than the dimensional thickness of the bag taken through standard side gussetted areas. Also of great importance in the industry is that when multi-walled bags are stacked, the handle areas can cause "pillars" to build vertically within stacked bundles. These "pillars" cause bag wrinkling to occur. Bag wrinkling is the nemesis of multi-wall bag handling. The wrinkles can cause bag failure when using standard automated bag filling machines. The elimination of bag wrinkling is a primary goal of the present invention.

Equal to the need to eliminate bag wrinkling, is the desire to provide a thin flexible handle that is comfortable to grasp. While the construction of polyethylene handles in various configurations is known, none has provided a sufficiently hingeable handle that allows for a comfortable grip area to be offered to the consumer for lifting and carrying a heavy bag. When present day plastic handles are molded to have a very thin profile in order to lie flat against the exterior of the flattened bag prior to filling, they create a sharp gripping edge, which can cut into the purchaser's hand. As a result the invention is directed toward providing a flat contour for bag handling and elimination of wrinkling, a sufficiently strong handle to carry the load, an attachment provision that does not tear out normal stiched closure strips, and lastly, a comfortable grip for the purchaser.

SUMMARY OF THE INVENTION

The inventive hinged handle satisfies the foregoing needs and overcomes the problems in the prior art by providing a thin flat construction having a thickness of from about 0.050 to about 0.070 inches. This thickness reduces, and substantially eliminates, bag wrinkling. Significantly, the hinged handle provides a thickness in the handle zone of the bag no greater than the gusset areas when a plurality of bags are stacked. The inventive handle in combination with the multi-wall bag allows the bags to be stacked flat, which prior art handles do not permit.

The hinged handle provides a pivoting action caused by hinged-action notches allowing the consumer to hold the handle and support the bag in a comfortable manner for carrying. The hinged handle may be constructed through known plastic molded techniques and can be affixed to multiple ply paper bags by manual or automated packaging equipment.

The hinged handle has a generally open U-shaped with widened bases sufficient for tear-free attachment to the threaded sewn closure strip of a multi-wall bag. Legs of the U-shape join a pivoting grip at the hinged-action notches adjacent an inner curved edge of a pivoting grip, which allows the grip to pivot, or rotate, generally transverse to the legs of the U-shaped for ease of carrying.

BRIEF DESCRIPTION OF THE DRAWINGS

The drawings illustrate a preferred embodiment for the invention, although the invention may take a wide variety of equivalent configurations. The drawings consist of the following.

DETAILED DESCRIPTION OF THE INVENTION

Figure 2:
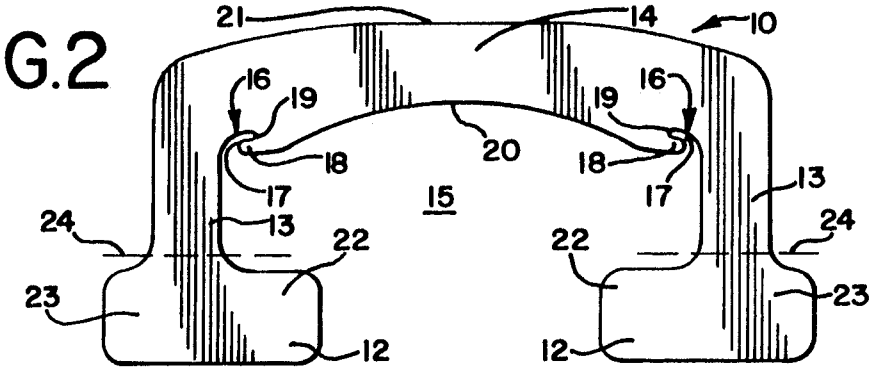
FIG. 2 wherein a plan view of the hinged handle is illustrated.

Reference will now be made to the Figures wherein like reference numerals refer to the same elements throughout.

Figure 1:
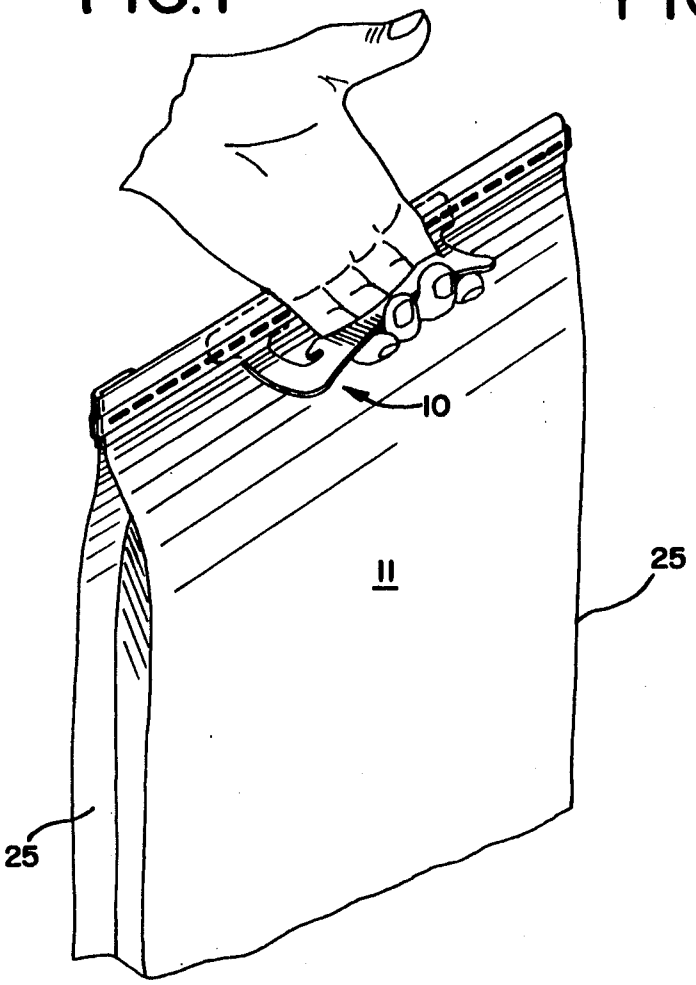
FIG. 1 wherein a perspective view of a person grasping the hinged handle affixed to a multi-wall bag is shown.

Turning first to FIG. 1, the inventive hinged handle 10 is depicted as it is being grasped by a consumer's hand for lifting a filled multiple ply bag 11 having a lower portion thereof broken away for purposes of illustration. The hinged handle 10 provides a comfortable gripping surface as it flexibly pivots upward for ease of support by the fingers.

Figure 3:
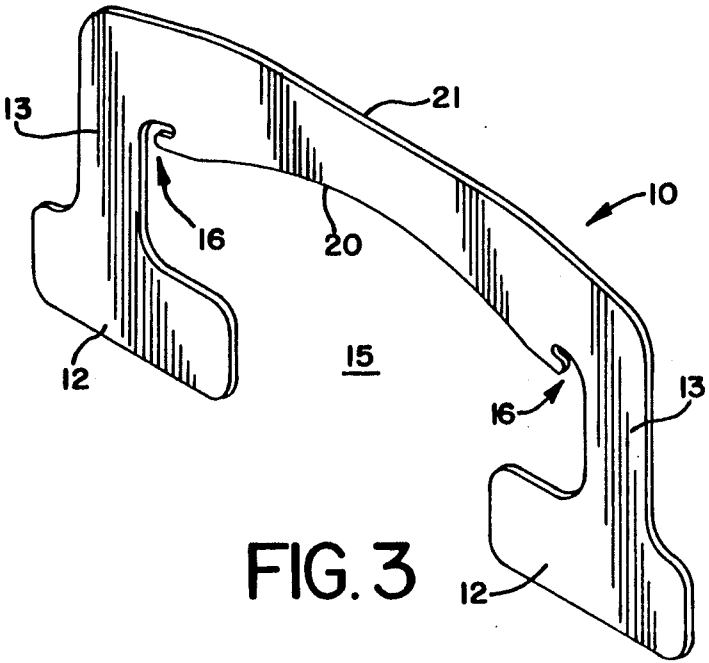
FIG. 3 wherein a perspective view of the hinged handle is provided.

More specifically, the construction of the hinged handle 10 is shown in greater detail in FIGS. 2 and 3. The hinged handle 10 has a general U-shape generally defined by a pair of attachment bases 12 providing bag attachment surfaces and legs 13 extending therefrom to be interconnected by a pivoting grip 14 extending therebetween. The downwardly open portion of the U, generally referenced at 15, includes, at upper left hand and right hand corners, hinged action notches 16 residing generally at the joinder of the legs 13 to the pivoting grip 14. The hinged action notches 16 are defined by an interior compound radiused recess 17 formed to have oppositely directed rounded projections 18. The recesses 17 curve U-inwardly to generally terminate, and point in opposing directions, at ends 19, which creates a pivot action hinge whereby an inner curved edge 20 of the handle meets the rounded projections 18 and is pivotable generally transversely to the legs 13. The edge 20 pivotably rotates along with an outer curved edge 21 of the handle, forming therebetween a finger-grasping area of the pivoting grip 14, as the bag 11 is carried by the consumer, best viewed in FIG. 1.

The attachment bases 12 of the hinged handle 10 provide the attachment surfaces for connecting the handle 10 to the bag 11. The bases 12 include a opposingly directed widened portions 22 and opposingly directed narrower extending portions 23. The span defined by the portions 22 and 23 is in the preferred embodiment approximately 1½ inches wide where each base 12 may be sewn attached with the closure strip for the bag 11, as well be described below.

The hinged handle 10 of the exemplary embodiment is injection molded polyethylene, which can be made in a multi-manifold die in a standard injection molding procedure. The material for hinged handle 10 must provide sufficient flexibility in order to allow the pivot grip 14 to pivot about the hinged-action notches 16. To this end, an ethyl vinyl alcohol or ethylene methyl acrylate additive is utilized to soften the polyethylene in order to make it sufficiently pliable and flexible. This additionally allows for a flexure and rotation of the legs 13 around the bases 12, generally at the joinder thereof shown at bend or flexure line 24. The hinged handle 10 is preferably made in a thickness range of from about 0.050 to about 0.070 inches, wherein 0.063 inches is provided in the preferred embodiment. The thickness is intended to be substantially the same as the thickness of the bag 11 at its gusseted edges 25, so that the bag 11 may be used in filling equipment without wrinkling.

Figure 4:
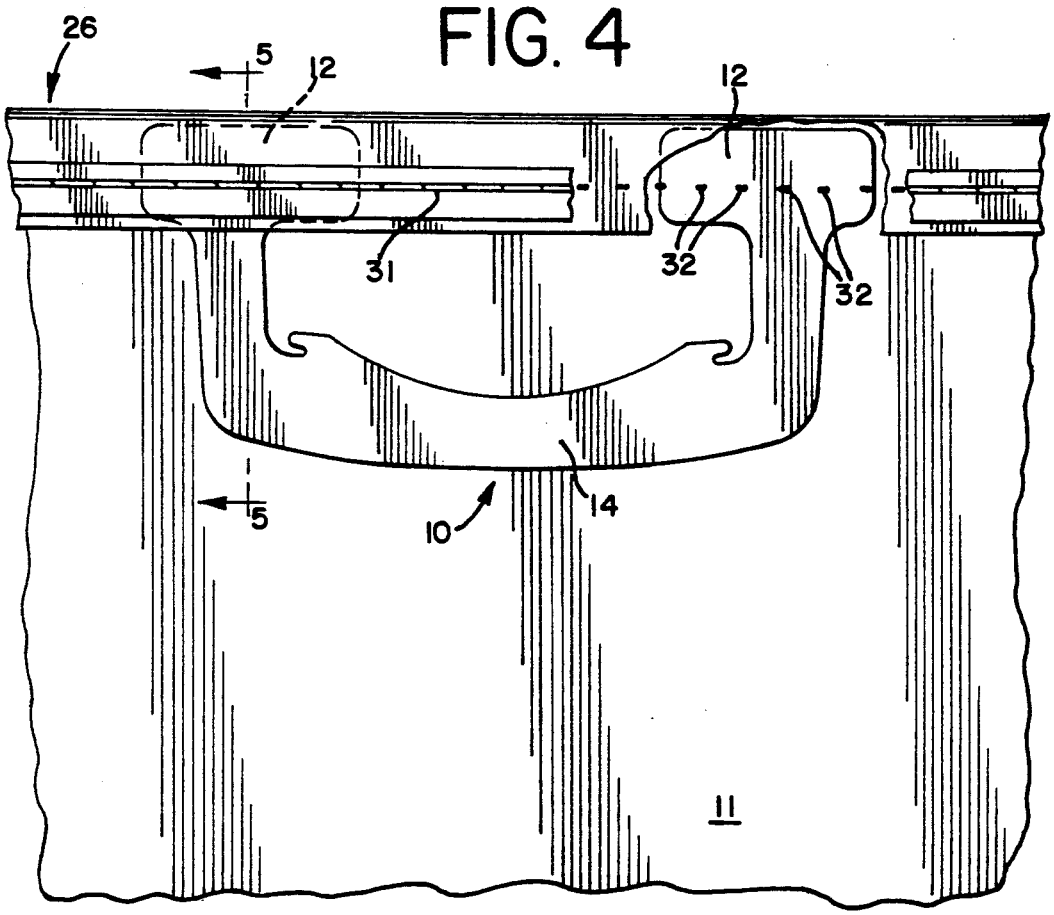
FIG. 4 wherein a front partial elevational view of the hinged handle attached to a multi-wall bag is illustrated in the flattened condition for storage and subsequent filling.
Figure 5:
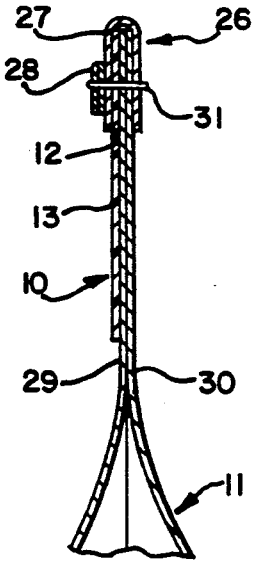
FIG. 5 wherein a sectional view of FIG. 4 is provided taken along line 5—5 thereof looking in the direction of the arrows.

With more specific reference to the construction of bag 11 and the attachment of the hinged handle 10, reference is now made to FIGS. 4 and 5. FIG. 4 is a broken-away plan view of the bag 11 having a closure strip 26 shown partially removed at one of the handle attachment bases 12 for purposes of illustration. The closure strip 26 comprises a folded over, adhesively secured paper strip 27 that is sewn to the bag and has at one side thereof a tear-off strip 28. The folded over paper strip 27 and the tear-off strip 28 are both stitched across the closed end of the bag shown at 31. The stitch spacing is provided as shown by the needle pierced holes 32 in FIG. 4 at 3–4 stitches per inch. Thereby, each attachment base 12 has at least four stitches affixing it to the bag. It will be seen in connection with FIG. 5 that the attachment bases 12 are secured between the outer surface of the plies 29 and inside of the folded strip 27. Thereby, when the closure strip 26 is stripped away to open the bag 11 the hinged handle 10 is also detached. The securement caused by the stitching 31 allows for the handle 10 to steadfastly attach to the bag 11 without tearing from it. Thus in the preferred embodiment it will be found that the attachment bases 12 are substantially wider than the legs 13.

It will be further understood from FIG. 5 that the front plies 29 and rear plies 30 each comprise multiple paper plies in a known way. They are however illustrated as single layers in cross-section for ease of illustration and to most clearly depict the flat arrangement of the hinged handle 10 against the outer exterior of the plies 29. This allows for the stacking of a plurality of empty bags prior to use without creating vertical "pillars" at the handles, which would otherwise create wrinkling. The invention avoids the wrinkling phenomenon that plagues prior art handles and causes jamming and stoppage of bag filling apparatus. Bag filling machinery demands a flat smooth bag construction to operate efficiently. The preferred embodiment envisions that the bag 11 may be filled and carried with about twenty to about thirty pounds of product therein.

For purposes of further specifying the exemplary embodiment, it is noted that the center portion of the pivoting grip 14 has a width of about $\frac{5}{8}$ inch which widens outwardly to about $\frac{7}{8}$ inch adjacent the hinged notches 16. Thus, a comfortable finger grasp surface is provided for carrying the bag 11. The attachment bases 12 extend transversely both to the left and to the right—U-inward and U-outward, respectively—of their respective legs 13, so that a secure attachment of the legs is made whereby non-eccentric pulling forces and tensile forces are created as the bag is lifted. Thus, the goal of the invention to avoid tearing the closure strips for packages is obtained.

While the preferred embodiment shows the attachment of the hinged handle 10 to a multiple wall bag 11, the invention is not limited to multi-ply bags and may also be provided for the attachment of the hinged handle 10 to other packages, such as soap detergent boxes, beverage cartons and the like, having an attachment surface available for the securement of the bases 12. For example, a heavy soap detergent box may have an adhesive attachment strip provided to secure the attachment bases 12 on the side of the box with the hinged handle 10 residing substantially flat against the box surface ready to be pivoted upwardly when grasped by the consumer's hand. Similarly, the hinged handle 10 may be sewn-attached to other packages, or otherwise riveted, stapled or mechanically fastened, to package surfaces, all within the scope of the invention.

The material comprising the hinged handle 10 is not limited to polyethylene. Other equivalent well-suited flexible plastics may be used.

Accordingly, a wide variety of equivalents will be seen to be encompassed by the scope of the claims appended hereto.

What is claimed is:

1. A substantially planar flat flexible handle for packages comprising: a pair of attachment bases;

legs extending from said attachment bases and having a width less than the width of said attachment bases;

a pivot grip member extending between said legs;

a hinged-action notch formed in said pivot grip member to each side thereof and positioned at a location where said pivot grip member joins said legs whereby to allow said pivoting grip member to pivot relative to said legs;

whereby said handle provides multiple flexure joints such that said pivot grip member and said legs flex as a unit about and with respect to said attachment bases and such that said pivot grip member flexes about and with respect to said legs.

2. The handle as in claim 1 wherein said handle has a generally U-shaped configuration.

3. The handle as in claim 2 wherein said hinged-action notches are positioned inwardly at said U-shape configuration where said pivotal grip member joins said legs.

4. The handle as in claim 1 wherein said handle comprises an injection molded and softened polyethylene.

5. The handle as in claim 1 wherein said hinged-action notches include oppositely opening curved recesses.

6. The handle as in claim 1 wherein said hinged-action notches include oppositely directed rounded projections and adjacent recesses, wherein an inner curved edge of the pivot grip member extends between said rounded projections.

7. The handle as in claim 1 having a thickness of from about 0.050 to about 0.070 inches throughout.

8. A multiple ply bag having a hinged handle comprising:

a multiple paper ply bag having a closed end;

a handle secured to said bag at said closed end, said handle having a pair of spaced-apart attachment bases secured to said bag, legs extending in the direction of the bag away from said closed end and being substantially coplanar with said attachment bases, said legs terminating in an interconnecting pivoting grip lying substantially coplanar with said legs and attachment bases, hinged-action notches at the connections of said legs and pivoting grip, said pivoting grip being pivotal at said hinged-action notches whereby to be rotable transversely to said legs.

9. The multiple ply bag and hinged handle as claimed in claim 8 wherein said attachment bases are wider than said legs.

10. The multiple ply bag and hinged handle as claimed in claim 8 wherein said hinged-action notches comprise curved recesses being open in generally opposite directions.

11. The multiple ply bag and hinged handle as claimed in claim 8 wherein said hinged handle has a generally U-shaped configuration.

12. The multiple ply bag and hinged handle as claimed in claim 11 wherein said hinged-action notches are located at the connections of said pivoting grip and said legs inwardly of the U-shape.

13. The multiple ply bag and hinged handle as claimed in claim 8 wherein said closed end includes means forming a closure strip said attachment bases being secured at said means forming a closure strip.

14. A package and handle attached thereto comprising: means securing spaced-apart attachment bases of a handle to a package, said handle being disposed over an exterior surface of said package;

said handle having coplanar legs extending from said attachment bases and a grip member pivotally joined to said legs at hinged-action notches;

said legs being flexible wherein upon the handle being grasped by the human hand said grip member turns relative to said legs to reside transversely thereto.

15. The package and handle as claimed in claim 14 wherein said handle has a thickness in the range of from about 0.050 inches to about 0.070 inches.

16. The package and handle as claimed in claim 14 wherein said attachment bases include extending portions extending to both sides of said legs.

17. The package and handle as claimed in claim 14 wherein said package includes a closure strip and said attachment bases are secured by said securing means between said closure strip and said package.

18. A multiple ply paper bag for receiving a product therein and having a seal-closed end, said sealed-closed end comprising an adhesive securement of paper bag plies and a sewn-attached closure strip, a flexible thin handle lying substantially flat against an exterior surface of said bag, the handle having means for attachment thereof engaged along said closure strip and legs extending therefrom, a pivoting grip interconnecting said legs at hinged-action notches therebetween, said hinged-action notches including recesses opening in opposite directions and residing generally at either end of an inner curved edge of said pivoting grip.

19. The multiple ply paper bag as claimed in claim 18 wherein said means for attachment are substantially wider than said legs.

20. The multiple ply paper bag as claimed in claim 18 wherein said handle has a generally U-shaped configuration and wherein said hinged-action notches reside at sides of said legs and pivoting grip inwardly of the U-shape.

21. The multiple ply paper bag as claimed in claim 18 wherein said means for attachment are sewn to said bag to be disposed underneath said closure strip.

22. The multiple ply paper bag as claimed in claim 18 wherein said sewn-attached closure strip having three to four stiches per inch and wherein said means for attachment receiving at least three stitches each.

* * * * *